US008056647B2

(12) United States Patent
Folin et al.

(10) Patent No.: US 8,056,647 B2
(45) Date of Patent: Nov. 15, 2011

(54) FIRST AND SECOND BEAM FOR TELESCOPIC FEEDER, INCORPORATING GUIDING STUDS, TELESCOPIC FEEDER, DRILLING DEVICE FOR ROCK DRILLING AND A WAY OF USING A GUIDING STUD

(75) Inventors: Richard Folin, Arboga (SE); Fredrik Saf, Vintrosa (SE)

(73) Assignee: Atlas Copco Rock Drills AB, Orebro (SE)

( * ) Notice: Subject to any disclaimer, the term of this patent is extended or adjusted under 35 U.S.C. 154(b) by 224 days.

(21) Appl. No.: 12/223,840

(22) PCT Filed: Jan. 22, 2007

(86) PCT No.: PCT/SE2007/000057
§ 371 (c)(1),
(2), (4) Date: Aug. 11, 2008

(87) PCT Pub. No.: WO2007/097676
PCT Pub. Date: Aug. 30, 2007

(65) Prior Publication Data

US 2010/0155092 A1 Jun. 24, 2010

(30) Foreign Application Priority Data

Feb. 22, 2006 (SE) ..... 0600385

(51) Int. Cl.
*E21B 19/08* (2006.01)

(52) U.S. Cl. ..... 173/39; 173/38

(58) Field of Classification Search ..... 173/39, 173/148, 38
See application file for complete search history.

(56) References Cited

U.S. PATENT DOCUMENTS

| | | | | | |
|---|---|---|---|---|---|
| 3,150,723 | A | * | 9/1964 | Hale | 173/37 |
| 3,612,190 | A | * | 10/1971 | Wills | 173/20 |
| 3,627,436 | A | * | 12/1971 | Adams et al. | 408/63 |
| 3,692,124 | A | * | 9/1972 | Kimber et al. | 173/160 |
| 3,721,471 | A | * | 3/1973 | Bergmann et al. | 299/55 |
| 3,896,885 | A | * | 7/1975 | Dahlstrom et al. | 173/2 |
| 3,902,561 | A | * | 9/1975 | Friberg et al. | 175/52 |
| 3,965,997 | A | * | 6/1976 | Hilding et al. | 175/65 |
| 3,980,144 | A | * | 9/1976 | Roos et al. | 173/160 |
| 3,993,271 | A | * | 11/1976 | Kimber | 248/654 |
| 4,124,081 | A | * | 11/1978 | Deike | 173/28 |
| 4,251,046 | A | | 2/1981 | Walmsley et al. | |
| 4,266,171 | A | * | 5/1981 | Mashimo | 318/571 |
| 4,290,491 | A | * | 9/1981 | Mayer | 173/194 |
| 4,401,930 | A | * | 8/1983 | Kato et al. | 318/603 |

(Continued)

FOREIGN PATENT DOCUMENTS

FR 2744489 8/1997

(Continued)

*Primary Examiner* — Brian D Nash
(74) *Attorney, Agent, or Firm* — Mark P. Stone

(57) ABSTRACT

The object of the invention is to provide a telescopic feeder which is easier to handle. A first beam is intended to be used in sliding cooperation with a second beam in a telescopic feeder for a rock drilling machine. The first beam comprises at least one guiding stud intended to be guided into a recess in the second beam as the second beam and the first beam are retracted to an end position. The guiding stud is used for locking the first beam in relation to the second beam in a fixed position as the telescopic feeder is fully retracted to an end position.

21 Claims, 4 Drawing Sheets

U.S. PATENT DOCUMENTS

| | | | | |
|---|---|---|---|---|
| 5,273,124 | A * | 12/1993 | Lloyd et al. | 175/162 |
| 5,678,642 | A * | 10/1997 | Briggs et al. | 175/19 |
| 5,884,712 | A * | 3/1999 | Hakkinen | 173/11 |
| 6,009,957 | A * | 1/2000 | Esko et al. | 173/4 |
| 2003/0136571 | A1* | 7/2003 | Linberg | 173/162.2 |
| 2006/0042811 | A1* | 3/2006 | Hagemeyer | 173/1 |
| 2007/0227752 | A1* | 10/2007 | Voimanen et al. | 173/11 |
| 2008/0169113 | A1* | 7/2008 | Rubie | 173/141 |

FOREIGN PATENT DOCUMENTS

| | | |
|---|---|---|
| WO | 9518912 | 7/1995 |

* cited by examiner

FIRST AND SECOND BEAM FOR TELESCOPIC FEEDER, INCORPORATING GUIDING STUDS, TELESCOPIC FEEDER, DRILLING DEVICE FOR ROCK DRILLING AND A WAY OF USING A GUIDING STUD

TECHNICAL FIELD

The present invention relates to a first beam intended to be used in sliding cooperation with a second beam in a telescopic feeder for a rock drilling machine. The present invention also relates to a telescopic feeder for a drilling machine for rock drilling, a drilling device for rock drilling and a way of using of a guiding stud.

BACKGROUND OF THE INVENTION

In bolting in narrow drifts in mines, there is often a conflict between the desired advance per round for the blast hole drilling and the feeding length in bolt drilling. If the required length for the blasting was to be drilled, the feeder would be so long that it would not be possible for it to be arranged transversely in the drift. One way of solving this problem is to use a feeder with displaceable drilling supports, another is to use a telescopic feeder. A telescopic feeder has a first beam and a second beam which is slidably arranged on the first beam. The length of the telescopic feeder may be changed so that it may be extended to the desired length in a drilling condition and retracted which results in that it may be accommodated transversely in the drift when needed.

An example of a telescopic feeder is disclosed in WO9518912. This telescopic feeder comprises a first beam and a second beam slidably arranged on the first beam. The disadvantage of this design is however that there are many slide blocks between the different moving parts of the telescopic feeder. Since the slide blocks have to be adjusted as they are worn, the maintenance work is greater on the telescopic feeder as compared to regular feeders. In particular, the adjustments of the slide blocks between the two beam profiles are difficult and time consuming to adjust correctly.

SUMMARY OF THE INVENTION

It is therefore an object of the present invention to provide a telescopic feeder which is easier to handle.

According to the present invention, this object is achieved by a first beam intended to be used in sliding cooperation with a second beam in a telescopic feeder for a rock drilling machine. The first beam comprises at least one guiding stud intended to be guided into a recess in the second beam as the second beam and the first beam are retracted to an end position.

According to the present invention, this object is also achieved by a telescopic feeder for a drilling machine for rock drilling. The telescopic feeder comprises a second beam, and the first beam according to the present invention.

According to the present invention, this object is also achieved by a drilling device for rock drilling. The drilling device comprises a drilling machine and a telescopic feeder according to the present invention.

According to the present invention, this object is also achieved by a way of using a guiding stud by arranging it on a first beam, which first beam is slidably arranged at a second beam in a telescopic feeder for a rock drilling machine. The guiding stud is used so as to be guided into a recess arranged on the second beam for locking the first beam in relation to the second beam in a fixed position as the telescopic feeder is fully retracted to an end position.

Since the first beam comprises a guiding stud adapted to the guided into a recess in the second beam as the second beam and the first beam of the telescopic feeder are retracted to an end position, the first beam will be guided into the second beam so that the beams in an easy manner will find and become arranged in a fixed position in their initial positions in relation to one another. This means that in the end position, the sliding arrangement will be easy to adjust.

An advantage of the present invention is that the slide blocks of the sliding arrangement may easily be replaced without disassembling the telescopic feeder.

A further advantage of the present invention is that the beams are fully fixed to one another in the end position which increases the stability of the telescopic feeder during for example bolt drilling and displacement/movement of the drilling rig.

DETAILED DESCRIPTION

A number of embodiments of the invention will now be described with reference to the drawings.

Figure 1:
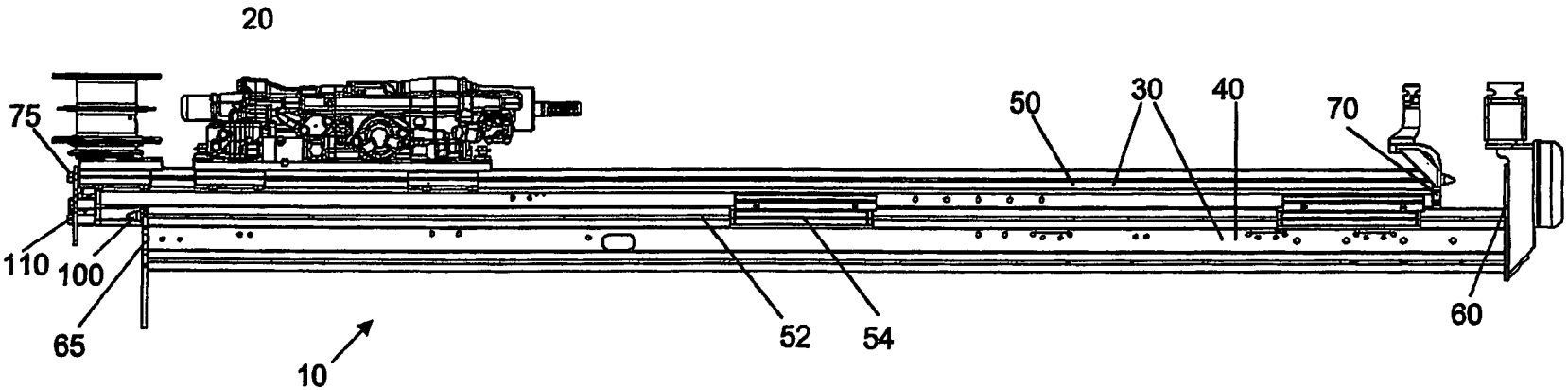
FIG. 1 is a schematic side view of a drilling arrangement for rock drilling according to the present invention.
Figure 2:
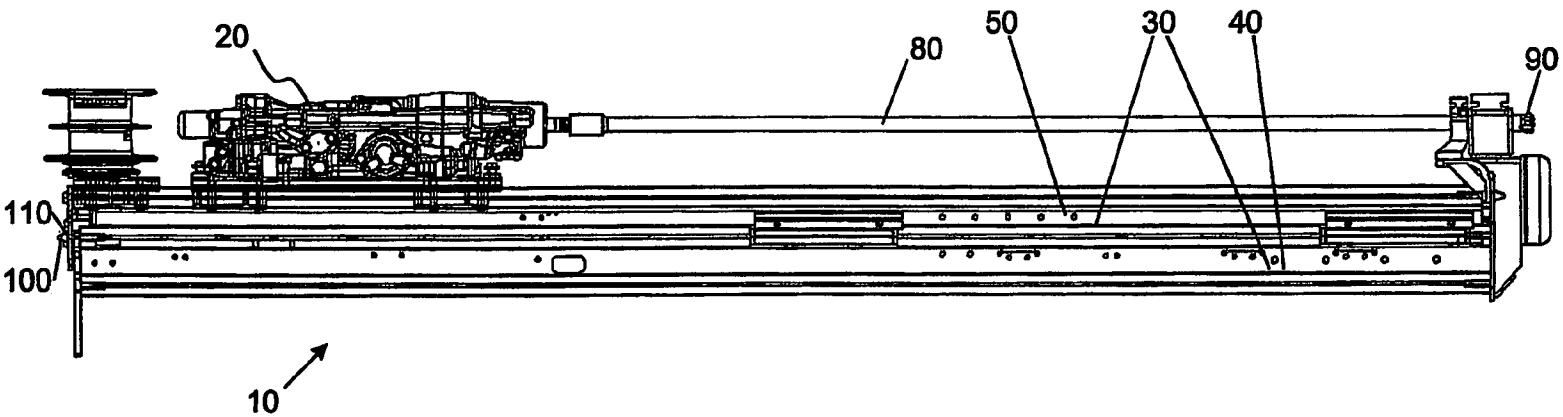
FIG. 2 is a schematic side view of a drilling arrangement for rock drilling according to the present invention.

FIG. 1 discloses a drilling device 10 for rock drilling. The drilling device 10 comprises a drilling machine 20 and a telescopic feeder 30, which telescopic feeder 30 comprises a first beam 40 and a second beam 50. The first beam 40 is slidably arranged on the second beam 50 and both the beams 40, 50 slide along their respective longitudinal axes. The first beam 40 and the second beam 50 are arranged parallel to one another and thus slide parallel to one another. This is achieved in a conventional way by means of sliding devices such as for example slide rails 52 and slide blocks 54. The telescopic feeder 30 has an end position in which the first beam 40 and the second beam 50 are in a fully overlapping relation, this end position is illustrated in FIG. 2. The length of the telescopic feeder 30 may be changed so that it extends by displacing the first beam 40 and the second beam 50 so that they are less and less in an overlapping relation up to a maximum extended position. The telescopic feeder 30 in FIG. 1 is extended a small distance from its end position. The first beam 40 has a front end 60 and a rear end 65, which front end 60 is defined as the end which is facing the object to be drilled, e.g. rock, and the rear end 65 is defined as the end which is located remotely from the object to be drilled. Likewise, the second beam 50 has a front end 70 and a rear end 75, which front end 70 is defined as the end which is facing the object to be drilled, e.g. rock, and the rear end 75 is defined as the end which is located remotely from the object to be drilled. The drilling machine 20 is slidably arranged on the telescopic feeder 30 so as to be displaceable along the telescopic feeder 30. The drilling machine 20 is thus movable back and forth along the longitudinal axis of the telescopic feeder 30. In FIG. 2, the boring tool 80 and the boring bit 90 which are arranged in the drilling machine 20 are also illustrated.

Figure 4:
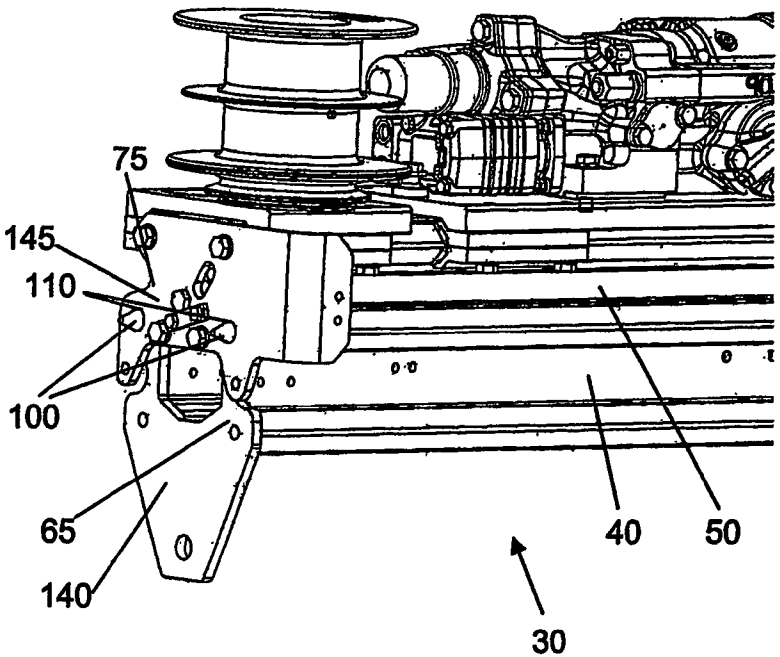
FIG. 4 is a schematic perspective view of a rear end of a telescopic feeder according to the present invention.
Figure 3:
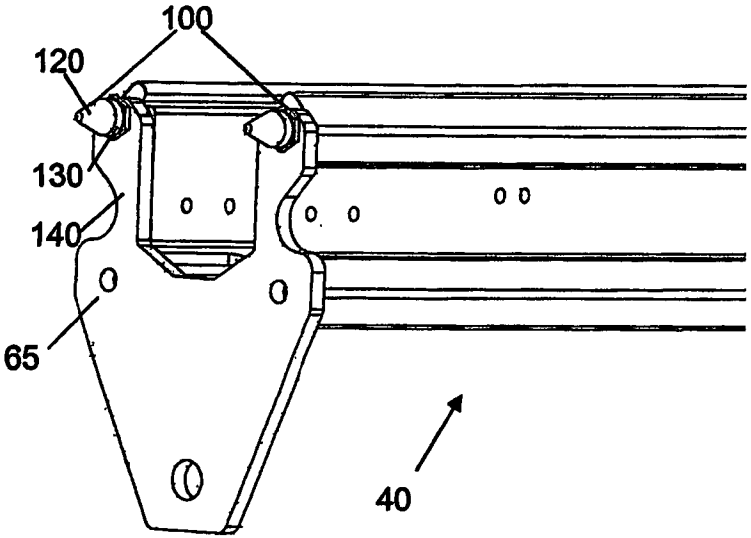
FIG. 3 is a schematic perspective view of a rear end of a first beam according to the present invention.
Figure 6:
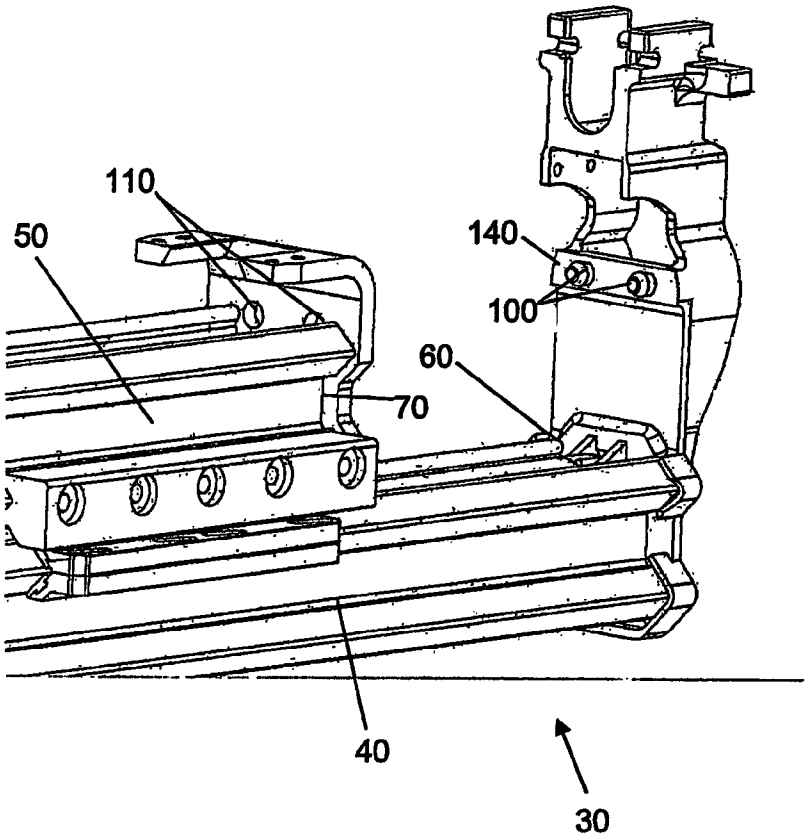
FIG. 6 is a schematic perspective view of an alternative embodiment of a front end of a telescopic feeder according to the present invention.
Figure 5:
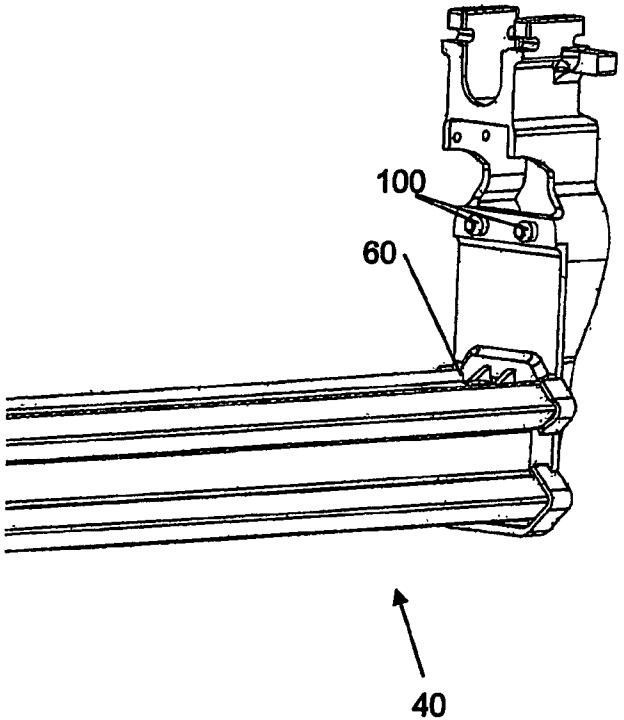
FIG. 5 is a schematic perspective view of an alternative embodiment of a front end of a first beam according to the present invention.

FIG. 3 illustrates a perspective view of the rear end of the first beam 40. In this example, the first beam 40 constitutes the lower beam in the telescopic feeder 30, but the first beam 40 might just as well constitute the upper beam in the telescopic feeder 30. The first beam 40 comprises one or more guiding studs 100. Each guiding stud 100 is intended to be guided into a recess 110 arranged in the second beam 50. This is in order to lock the first beam 40 in relation to the second beam 50 in a fixed position as the telescopic feeder 30 is fully retracted to an end position. FIG. 4 illustrates how the rear end 65 of the first beam 40 interacts with the rear end 75 of the second beam 50. One or more guiding studs 100 may be arranged in the front end 60 of the first beam 40 and consequently be intended to be guided into recesses 110 of the front end 70 of the second beam 50. Alternatively, one or more guiding studs 100 may be arranged in the front end 60 of the first beam 40, which is illustrated in FIG. 5, and then be arranged to be guided into recesses 110 in the front end 70 of the second beam 50 which is illustrated in FIG. 6. Further options may be that one or more guiding studs 100 may be arranged both in the front end 60 and the rear end 65 of the first beam 40 and then be arranged to be guided into recesses 110 in both the front end 70 and the rear end 75 of the second beam 50. In the example of FIG. 3, the first beam 40 comprises two guiding studs 100 whereby both guiding studs 100 are arranged in the rear end 65 of the first beam. The guiding studs 100 are made of a suitable material with good abrasion and hardness properties such as for example steel. The guiding studs 100 have a respective rear portion (not shown), a front portion 120 and an intermediate portion 130. The guiding studs 100 are arranged in an appropriate manner on the first beam 40, for example by screwing, welding or pressing the rear portion into one or both of the ends 60, 65 of the first beam 40, or into an end plate 140, which end plate 140 is arranged at one or both ends 60, 65 of the first beam 40. The guiding studs 100 are arranged so as to extend from either one or both of the ends 60, 65 of the first beam 40 parallel to the longitudinal axis of the first beam 40. The front portion 120 and the intermediate portion 130 are preferably cylindrical with a cylindrical cross section. The size of the cylindrical cross section is adapted so that the guiding stud may fit into the recesses 110. In order for the guiding stud 100 to be more easily guided into the recesses 110, the front portion 120 is tapered. The cylindrical intermediate portion 130 is sufficiently long so as to allow a rigid locking with the recess 110 so that the telescopic feeder 30 remains in its fully retracted end position. The recess 110 may for example be in the shape of a cylindrical or tapered opening in one or both of the ends 70, 75 of the second beam 50 or for example in an end plate 145, which end plate 145 is arranged at one or both of the ends 70, 75 of the second beam 50. In this example, the recess 110 is arranged in the rear end 75 of the second beam 50 (see FIG. 4). In order for the telescopic feeder 30 to have as good a locking as possible when in a fully retracted end position, it is advantageous if there are locking points at both ends of the telescopic feeder 30 (see FIG. 1). A locking point is defined herein as a guiding stud 100 which engages with a recess 110. It is not essential at which ends of the first 40 and second 50 beams the guiding stubs 100 and the recesses 110, respectively, are arranged. This may be achieved in a plurality of ways, as been previously indicated. For example, the upper beam may comprise guiding studs at both its ends and no recesses at all and the lower beam may comprise recesses at both its ends and no guiding studs at all. In another alternative, the lower beam comprises guiding studs in both its ends and no recesses at all and the upper beam may comprise recesses in both its ends and no guiding studs at all. As a further option, the upper beam comprises guiding studs in its front end and recesses in its rear end and the lower beam comprises recesses in its front end and guiding studs in its rear end. As a further option, the upper beam comprises guiding studs in its rear end and recesses in its front end and the lower beam comprises recesses at its rear end and guiding studs at its front end. As previously mentioned, the first beam 40 may constitute either the lower beam in the telescopic feeder 30, or the upper beam in the telescopic feeder 30 and vice versa.

Figure 8:
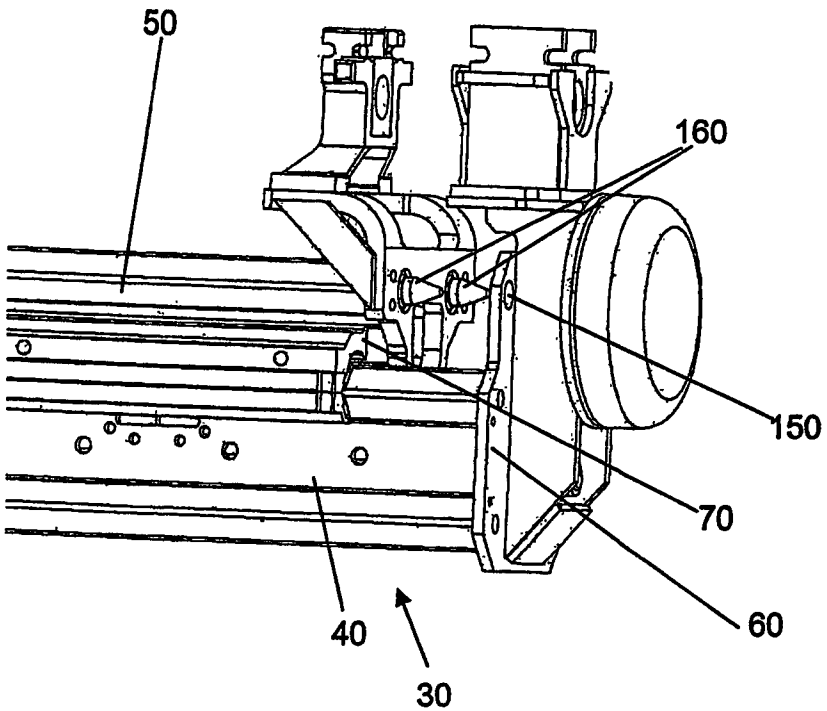
FIG. 8 is a schematic perspective view of a front end of a telescopic feeder according to the present invention.
Figure 7:
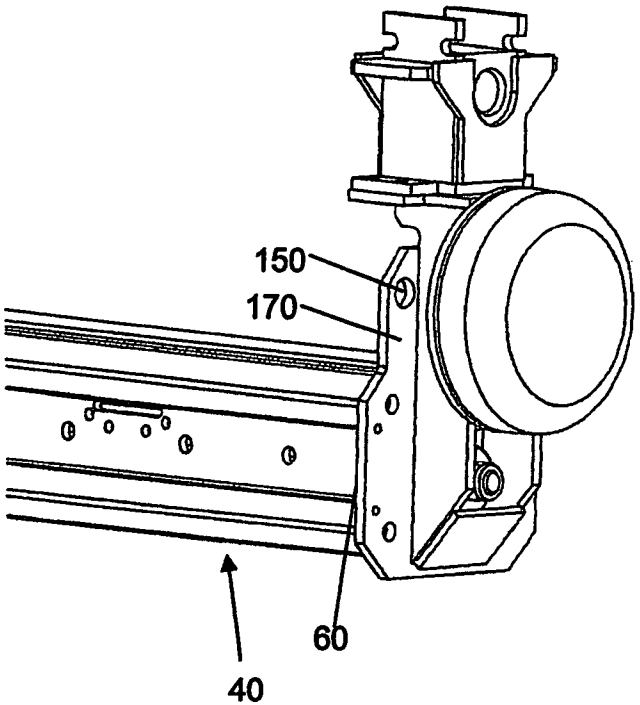
FIG. 7 is a schematic perspective view of a front end of a first beam according to the present invention.

FIG. 7 illustrates a perspective view of an embodiment of the front end 60 of the first beam 40. The first beam 40 comprises no or at least one recess 150 intended to interact with a guiding stud 160 in the second beam 50. How the front end 60 of the first beam 40 and the front end 70 of the second beam 50 interact is illustrated in FIG. 8. In the example in FIG. 7 and FIG. 8, the first beam 40 comprises two recesses 150, whereby both recesses 150 are arranged at the front end 60 of the first beam 40, however, one or more recesses 150 might just as well be arranged on the rear end 65 of the first beam (not shown). The guiding studs 160 on the second beam 50 are arranged so as to extend from any one of the ends 70, 75 of the second beam 50 parallel to the longitudinal axis of the second beam 50 which is also parallel to the longitudinal axis of the first beam 40. Each recess 150 is designed so that it may receive a guiding stud 160. The recesses 150 may for example be in the shape of a cylindrical or tapered circular opening at the front end of the first beam 40 or in an end plate 170 which end plate 170 in this example is arranged at the front end 60 of the first beam 40. The circular openings of the recesses 150 are arranged perpendicular to the longitudinal axis of the first beam 40. Each recess 150 is arranged so that when the telescopic feeder 30 is fed to its end position, the tip of the front end of the interacting guiding stud 160 will be located somewhere in front of the recess 150 and thereafter be guided into the recess 150. The first beam 40 and the second beam 50 in the telescopic feeder should be arranged parallel and at a certain distance from one another, i.e. arranged in a certain manner in relation to one another, a so called initial position, in order for drilling to be carried out in a stable manner. As the telescopic feeder 30 is used the sliding arrangement, i.e. in this example the slide blocks 54, will become worn so that the first beam 40 and the second beam 50 will depart from their initial position in relation to one another, the slide blocks 54 then have to be adjusted so that the first beam 40 and the second beam 50 again assume their initial position in relation to one another. The purpose of the guiding studs 100, 160 and the recesses 110, 150 is really to guide the first beam 40 and the second beam 50 so that they easily find their initial position and are in a fixed position in their initial position in relation to one another as they are retracted to the end position. In the end position, the sliding arrangement, i.e. in this case the slide rails 52, may be easily adjusted so that when the telescopic feeder 30 is subsequently extended once again, the first beam 40 and the second beam 50 will maintain their initial positions until the slide blocks are starting to become worn again. It is thus advantageous that the guiding studs 160 are tapered and pointed at their front ends and that the opening of the recess 150 is large enough so that the guiding stud may be captured by the recess 150. The larger the opening of the recess 150, the more the slide blocks 54 may be allowed to be worn before the guiding stud 160 is displaced to such an extent from its position in relation to the recess 150 that the guiding stud 160 will no longer engage the opening of the recess 150 and will instead engage the surroundings of the opening in the recess 150 as the telescopic feeder 30 is retracted to its end position. Adjustment of the slide rails should thus be made before they have been worn to such an extent that the guiding stud 160 ceases to engage the opening of the recess 150.

The first beam 40 may constitute the lower beam and the second beam 50 then constitutes the upper beam or vice versa. The first beam comprises as mentioned above, one or more guiding studs 100 and no, one or more recesses 150. The second beam 50 comprises no, one or more guiding studs 160 and one or more recesses 110. It is most advantageous if the telescopic feeder 30 has locking points at both its ends as mentioned above, which may be achieved by e.g. the following combinations:

1) The first beam 40 comprises one or more guiding studs 110 arranged at its front end 60 and one or more recesses 150 arranged at its rear end 65, the second beam 50 comprises one or more recesses 110 arranged at the front end 70 and one or more guiding studs 160 arranged at its rear end 75.
2) The first beam 40 comprises one or more recesses 150 arranged at its front end 60 and one or more guiding studs 110 arranged at its rear en 65, the second beam 50 comprises one or more guiding studs 160 arranged at its front end 70 and one or more recesses 110 arranged at its rear end 75.
3) The first beam 40 comprises one or more guiding studs 110 arranged at its front end 60 and one or more guiding studs 110 arranged at its rear end 65, the second beam 50 comprises one or more recesses 110 arranged at its front end 70 and one or more recesses 110 arranged at its rear end 75.

The present invention is not limited to the embodiments hereinabove. Various variants, equivalents and modifications may be used. Therefore, the embodiments should not be considered as limitations of the scope of the invention, which scope is defined by the appended claims.

The invention claimed is:

1. A telescopic feeder device for a rock drilling machine, said device comprising a first beam arranged in sliding cooperation with a second beam, said first and second beams arranged for sliding in parallel along their respective longitudinal axes between a fully retracted end position of said feeder device and a fully extended end position of said feeder device, said feeder device further comprising an adjustable sliding arrangement for maintaining the first and second beams at a predetermined distance from each other, wherein the first beam comprises at least one guiding stud extending from and beyond one end of said first beam and in parallel with the longitudinal axes of said first and second beams, and wherein said at least one guiding stud is guided into at least one recess in the second beam during retraction of the first and second beams to engage with the recess in the fully retracted end position of the feeder device to allow adjustment of the sliding arrangement when said at least one guiding stud is engaged with the recess.

2. The device according to claim 1, wherein the first beam extends along a longitudinal axis and wherein the guiding stud extends in the same direction as the longitudinal axis of the first beam.

3. The device according to claim 1, wherein the guiding stud has a front portion, which front portion is tapered.

4. The device according to claim 1, wherein the first beam comprises a front end which front end is the end which is facing the object to be drilled when drilling, and wherein the first beam comprises a rear end which rear end is the end which is located remotely from the object to be drilled when drilling, and wherein the guiding stud is arranged at the front end and/or the rear end of the first beam.

5. The device according to claim 1, wherein the guiding stud is attached to the first beam by means of welding, screwing or pressing.

6. The device according to claim 1, wherein the guiding stud is arranged in the first beam by an end plate.

7. The device according to claim 1, wherein the guiding stud is made of steel.

8. The device according to claim 1, wherein the first beam comprises at least one recess for cooperating with a guiding stud in the second beam.

9. The device according to claim 8, wherein the recess is arranged in the front end or rear end of the first beam.

10. The device according to claim 1, wherein said first beam and said second beam fully overlap each other in said fully retracted end position.

11. The device according to claim 1, wherein said recess is arranged in one end of said second beam.

12. Telescopic feeder for a drilling machine, said telescopic feeder comprising a first beam and a second beam, said first beam having at least one guiding stud extending from and beyond at least one end thereof and in parallel with the longitudinal axes of said first and second beams, said first and second beams arranged for sliding along said respective longitudinal axes between a fully retracted end position of said feeder device and a fully extended end position of said feeder device, said feeder device comprising an adjustable sliding arrangement for maintaining a predetermined distance between said first and second beams, wherein the second beam is slidably arranged on the first beam, and wherein the second beam comprises at least one recess, into which recess the guiding stud of the first beam is guided in the fully retracted end position of the feeder device to allow adjustment of the sliding arrangement when said at least one guiding stud is engaged with the recess.

13. Telescopic feeder according to claim 12, wherein the recess comprises a cylindrical or a tapered circular opening.

14. Telescopic feeder according to claim 12, wherein the recess is arranged in an end plate, which end plate is arranged at one of the ends of the second beam.

15. Telescopic feeder according to claim 12, wherein the second beam comprises a front end, which front end is the end which is facing the object to be drilled when drilling, and wherein the second beam comprises a rear end which rear end is the end which is located remotely from the object to be drilled when drilling, and wherein the recess is arranged at the front end or rear end of the second beam.

16. Telescopic feeder according to claim 12, wherein at least one guiding stud is arranged at the front end or the rear end of the second beam.

17. Drilling device for rock drilling, comprising a drilling machine wherein the drilling device comprises a telescopic feeder according to claim 12.

18. Drilling device according to claim 17, wherein the drilling machine is slidably arranged on the telescopic feeder so that it is displaceable along the longitudinal axis of the telescopic feeder.

19. Telescopic feeder according to claim 12, wherein said first beam and said second beam fully overlap each other in said fully retracted end position.

20. A method of guiding a first beam relative to a second beam in a telescopic feeding device for a rock drilling machine, the steps of said method comprising providing a guiding stud extending from and beyond at least one end of a first beam and in parallel with the longitudinal axes of said first and second beams; providing an adjustable sliding arrangement for maintaining said first and second beams at a predetermined distance from each other as said first and second beams are slid parallel to said respective longitudinal axes between a fully retracted end position of said feeding device and a fully extended end position of said feeding device; providing at least one recess on said second beam; guiding said at least one guiding stud of said first beam into said recess of said second beam when said feeding device is in said fully retracted end position; and adjusting the distance between said first and second beams by said adjustable sliding arrangement when said feeding device is in said fully retracted end position and said guiding stud engages said recess.

21. The method according to claim 20, wherein said first beam and said second beam fully overlap each other in said fully retracted end position.

* * * * *